United States Patent [19]

McCambridge

[11] 4,264,233

[45] Apr. 28, 1981

[54] FLUID DYNAMIC REPELLER FOR PROTECTING COAST FROM EROSION

[76] Inventor: Joseph McCambridge, 12 Watson La., Setauket, N.Y. 11733

[21] Appl. No.: 72,939

[22] Filed: Sep. 6, 1979

[51] Int. Cl.[3] ..... E02B 3/04

[52] U.S. Cl. ..... 405/26; 405/25; 405/21; 405/28

[58] Field of Search ..... 405/15–28, 405/76, 77, 75, 52; 9/8 R, 8.5, 9

[56] References Cited

U.S. PATENT DOCUMENTS

| | | | |
|---|---|---|---|
| 1,233,199 | 7/1917 | Fungo-Giera | 9/8 R |
| 1,318,650 | 10/1919 | Dutka | 9/8 R |
| 1,516,767 | 11/1924 | Falley | 405/28 |
| 3,191,202 | 6/1965 | Handler | 9/8 |
| 3,281,765 | 10/1966 | Taplin | 9/8 X |
| 3,498,246 | 3/1970 | Kiefer | 9/8 R |
| 3,846,990 | 11/1974 | Bowley | 405/26 |
| 4,004,308 | 1/1977 | Gongwer | 9/8 R |
| 4,048,677 | 9/1977 | Kajlick | 9/8 R |
| 4,048,802 | 9/1977 | Bowley | 405/26 |
| 4,130,994 | 12/1978 | Van Moss | 405/24 |

*Primary Examiner*—Dennis L. Taylor

*Attorney, Agent, or Firm*—Robert E. Burns; Emmanuel J. Lobato; Bruce L. Adams

[57] ABSTRACT

A system for protecting a coast from erosion by wave action of a body of water comprises one or more rows of fluid dynamic repellers anchored in the water near the shore line. Each of the fluid dynamic repellers comprises a top-shaped bouyant body tethered to an anchor on the bottom and having a plurality of laterally projecting arms. A paddle-like blade on each of the arms is inclined to the horizontal so as to deflect subsurface wave motion, thereby creating turbulence which dissipates wave action that would cause erosion of the coast.

11 Claims, 3 Drawing Figures

FLUID DYNAMIC REPELLER FOR PROTECTING COAST FROM EROSION

FIELD OF THE INVENTION

The present invention relates to prevention of coastal erosion by wave action or currents in the adjoining body of water. The term "coast" is used in a generic sense to include beaches and other shorelines whether of lakes, rivers, sounds, bays, oceans or other bodies of water.

BACKGROUND OF THE INVENTION

The ravages of coastal erosion are wide spread throughout the world. Beaches are destroyed or seriously damaged by continued erosion. In some areas the coastline recedes so that valuable land is lost and buildings fall into the sea.

Many attempts have been made to prevent or at least reduce coastal erosion. These have included the erection of stone jettees, break-waters and sea walls and planting variously shaped barriers along a beach. Further it has been proposed to anchor floating wave barriers in the water near the shoreline. However, these devices have not come into wide spread use, apparently because of high cost and ineffectiveness.

SUMMARY OF THE INVENTION

It is an object of the present invention to provide an effective and economically feasible system for protecting a coast from erosion. In accordance with the invention, one or more rows of submerged fluid dynamic repellers are anchored in the water near the shoreline. Each of the fluid dynamic repellers comprises a top-shaped buoyant body tethered to an anchor on the bottom so as to be suspended in the water below the surface. Each of the buoyant bodies has a plurality of laterally projecting arms on which there are provided paddle-like blades which are inclined to the horizontal so as to deflect sub-surface wave motion and currents thereby creating turbulence which dissipates the energy of the wave action and thereby protects the coast from erosion.

In deeper water, two or more fluid dynamic repellers are suspended one above the other. In shallower water, single fluid dynamic repellers are used. Thus for example a system for protecting a beach from erosion may comprise a row of single fluid dynamic repellers near the shoreline and a row of multiple fluid dynamic repellers farther from the shoreline and in deeper water.

BRIEF DESCRIPTION OF DRAWINGS

The nature, objects and advantages of the invention will appear more fully from the following description of preferred embodiments shown by way of example in the accompanying drawings in which.

DESCRIPTION OF PREFERRED EMBODIMENTS

Figure 1:
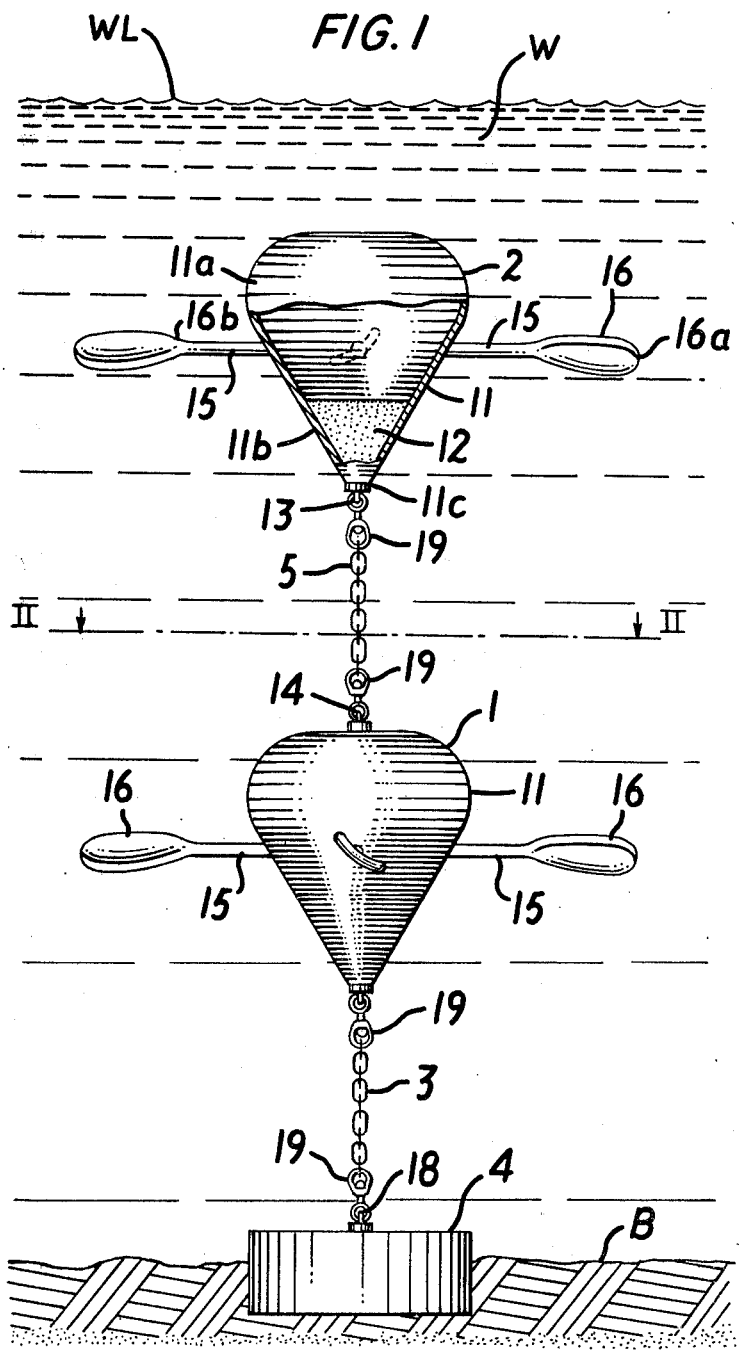
FIG. 1 is a side elevation partially in section of a multiple unit fluid dynamic repeller in accordance with the present invention.

In FIG. 1 there is shown by way of example a multiple unit fluid dynamic repeller installation in accordance with the present invention. The installation is shown as comprising a fluid dynamic repeller unit 1 tethered by a chain 3 to an anchor 4 on the bottom B of a body of water W and a second fluid dynamic repeller unit 2 tethered by a chain 5 to the first fluid dynamic repeller unit 1 so that the upper unit 2 is suspended in the water below the water surface WL and the lower unit 1 is suspended in the water between the upper unit and the anchor 4.

Each of the fluid dynamic repellers comprises a buoyant body 11 which is preferably "pear-shaped" or "top-shaped" as shown in FIG. 1 with a bulbous upper portion 11*a* and a conical lower portion 11*b* tapering down to an apex 11*c*. The body 11 has a specific gravity less than 1 so that it would float if free. As shown by way of example in FIG. 1, the body 11 is hollow and is made of suitable durable material such as fibreglass or non-corroding metal. To assist in keeping it in an upright position, the body 11 is ballasted, for example by ballast 12, in the lower conical portion 11*b*. The ballast 12 is, for example, sand, gravel, concrete or other stable relatively heavy material. It can be either granular, particulate, or solid. A ring 13 is provided at the lower end or apex of the body 11 for attachment of the chain 3 or 5. When another unit is to be tethered above as in the case of unit 1 in FIG. 1, a ring 14 is also provided at the top of the body 11 for attachment of a chain 5 by which an upper unit is tethered.

At approximately its midpoint in a vertical direction, the body 11 is provided with a plurality of laterally projecting arms 15. The arms 15 preferably project from the body 11 approximately at right angles to the axis of the body so as to be horizontal. At the end of each arm 15, there is provided a paddle-like blade 16 which is preferably integral with the arm. The outer ends 16*a* of the blades 16 are rounded, for example semicircular, while at the inner ends 16*b* the blades curve smoothly into the arms 15. As seen in FIG. 1, the blades are inclined to the horizontal. The angle of inclination is preferably between 30° and 60° to the horizontal and preferably between 40° and 45°. Moreover, in cross section the blades 16 are curved or "dished" with the concave side preferably facing upwardly. The arms 15 and blades 16 are preferably molded of plastic which may be suitably reinforced, for example with fibreglass, so as to provide greater strength. The arms 15 are securely and strongly attached to the body 11, for example by being molded integrally therewith or welded thereto. Each of the repellers has at least three arms and preferably not more than six. In a preferred embodiment of the invention as shown in the drawings, each repeller has four arms which are spaced at equal angles about the body.

The size of the repellers may vary according to the locations and conditions in which they are to be used. However, by way of illustrative examples, the repellers may have the following dimensions:

| | |
|---|---|
| Diameter of Body | 3 to 4 feet |
| Height of Body | 4 to 5 feet |
| Diameter of Arms | approximately 2 inches |
| Length of Arms (Exclusive of Blades) | 6 to 15 inches |
| Length of Blades | 2 to 3 feet |
| Width of Blades | 12 to 18 inches |

The anchor 4 is sufficiently heavy to keep the fluid dynamic repellers in place. It can, for example, by a solid cylindrical block of concrete provided with a ring 18 to which the chain 3 is attached. The chain 3 is attached to the anchor 4 and to the lower fluid dynamic repeller 1 by swivels 19 to permit rotation of the fluid dyanmic repeller with respect to the anchor. Likewise the chain 5 is attached to fluid dynamic repeller units 1 and 2 by swivels 19 to permit relative rotation of the two units. It will be understood that other connecting means such as cable or rope may be used in place of chain.

In use, the fluid dynamic repellers in accordance with the present invention are installed in the water near the shoreline. Depending on the gradient of the bottom, one row of fluid dynamic repellers may be 10 to 15 feet from the shoreline and a second row 20 to 50 feet from the shoreline. In each row the units are preferably 12 to 15 feet apart. Depending on the depth of the water, the inner row of fluid dynamic repellers may be single units, i.e. unit 1 without unit 2. The outer row of fluid dynamic repellers comprises multiple units which may be double units as shown by way of example in FIG. 3 or perhaps three or four units one above the other. The vertical distance between units is preferably about equal to the height of the units. As illustrated in FIG. 1, the units are suspended so that the upper unit is below the surface of the water.

A study of wave action has shown that waves produce sub-surface currents in the water having both vertical and horizontal components. It has been found that the blades of the fluid dynamic repellers in accordance with the present invention deflect sub-surface wave motion in the water to produce turbulence and thereby dissipate wave energy. The force of the waves is thereby decreased to a point where erosion is prevented or materially lessened. Thus a coastline is effectively protected by an installation of fluid dynamic repellers in accordance with the present invention described above. When two rows of fluid dynamic repellers are used, the units in one row are preferably staggered with respect to those of the other row so as to increase the effectiveness of the installation.

Figure 2:
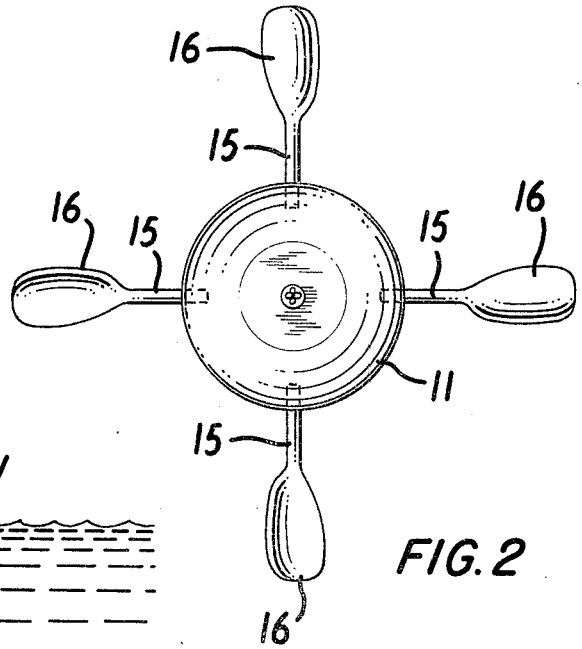
FIG. 2 is a plan of the lower unit taken approximately on the line II—II in FIG. 1.
Figure 3:
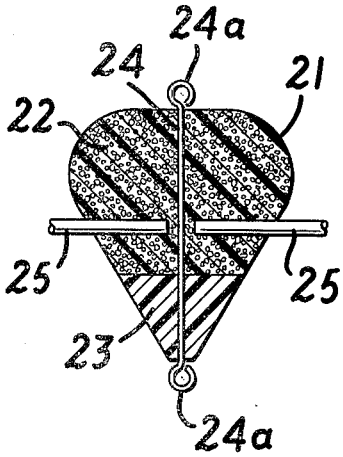
FIG. 3 is a vertical section through the body portion of a fluid dynamic repeller illustrating a modification.

In FIG. 3 there is shown a modification of the body portion of a fluid dynamic repeller in accordance with the present invention. The body 1 comprises an upper portion 22 formed of closed cell cellular plastic material while a lower portion 23 is molded of solid plastic and thereby serves to ballast the unit. A rod 24 extends vertically through the body and is provided at opposite ends with rings 24*a* for attachment of tethering means. Arms 25 are secured to the body by extending into the cellular plastic material of the portion 22. It will be understood that paddle-like blades are provided on the ends of the arms 25 as in FIGS. 1 and 2.

In some instances it may be found desirable to cover or coat the fluid dynamic repellers with anti-fouling means such as copper or anti-fouling paint to inhibit marine growth. However, as the fluid dynamic repellers are freely movable and are constantly in motion by reason of wave action, objectionable marine growth is unlikely to develop.

By reason of their smoothly rounded surfaces, fluid dynamic repellers in accordance with the present invention present no hazard to swimmers even if installed along beaches where swimming is allowed. Moreover, since the units are submerged, they do not present an obstacle to small boats. To protect the fluid dynamic repellers from being damaged by larger vessels, markers for example in the nature of floats or upwardly projecting antenna-like wands may be provided on the units. Alternatively or additionally, the area in which the fluid dynamic repellers are installed is identified by buoys or other suitable marine markers.

While preferred embodiments of the invention have been illustrated in the drawings and are herein described, it will be understood that many modifications and variations may be made and that the invention is in no way limited to the illustrated embodiments.

What is claimed is:

1. A fluid dynamic repeller for protection of a coat of a beach from erosion by wave action of a body of water, comprising a buoyant body, an anchor resting on the bottom of said body of water near the shoreline, flexible means connecting said bouyant body with said anchor to suspend said buoyant body in the water above said anchor, a plurality of arms projecting laterally from said buoyant body and a paddle-like blade on each of said arms, said blades being disposed at an angle to the horizontal, whereby said blades deflect sub-surface wave motion in said water to produce turbulence in the water and thereby dissipate wave action that would cause erosion of the coast.

2. A fluid dynamic repeller according to claim 1, in which said bouyant body is ballasted at its lower portion to cause said bouyant body to be suspended in an upright position in the water.

3. A fluid dynamic repeller according to claim 1, in which said arms are disposed symmetrically of said bouyant body.

4. A fluid dynamic repeller according to claim 1, in which said blades are inclined at an angle of 30° to 45° to the horizontal.

5. A fluid dynamic repeller according to claim 1, in which said flexible means includes swivel means permitting rotation of said bouyant body relative to said anchor.

6. A fluid dynamic repeller according to claim 1, in which said bouyant body is top-shaped with a bulbous upper portion and a conical lower portion tapering down to an apex to which said flexible means is secured.

7. A fluid dynamic repeller for protection of a coast from erosion by wave action of a body of water, comprising an anchor on the bottom of said body of water near the shoreline, a first repeller unit comprising a bouyant body, a plurality of arms projecting laterally from said bouyant body and a paddle-like blade on each of said arms, first flexible means connecting in said bouyant body with said anchor to suspend said bouyant body in the water above said anchor, a second repeller unit comprising a second bouyant body, a plurality of arms projecting laterally from said second bouyant body and a paddle-like blade on each of said arms, and second flexible means connecting said second bouyant body with said first bouyant body to suspend said second bouyant body in the water above said first bouyant body, whereby said blades deflect sub-surface wave motion in said water to produce turbulence in the water and thereby dissipate wave action that would produce erosion of the coast.

8. A fluid dynamic repeller according to claim 7, in which each of said bouyant bodies is ballasted at its lower portion to cause said bouyant body to be suspended in an upright position in the water with said arms extending horizontally.

9. A fluid dynamic repeller according to claim 8, in which each of said bouyant bodies is top-shaped with a bulbous upper portion and a conical lower portion tapering down to an apex to which said flexible means is attached.

10. A system for protecting a coast from erosion by wave action of a body of water, said system comprising a plurality of fluid dynamic repellers according to claim 1 positioned in the water near the shoreline and spaced from one another.

11. A system for protecting a coast from erosion by wave action of a body of water, said system comprising a plurality of fluid dynamic repellers according to claim 7, positioned in the water near the shoreline and spaced apart from one another.

* * * * *